United States Patent [19]

Lasky

[11] Patent Number: 4,500,088

[45] Date of Patent: Feb. 19, 1985

[54] 3D DISPLAY

[75] Inventor: Richard J. Lasky, Clifton, N.J.

[73] Assignee: Trans-World Manufacturing Corporation, E. Rutherford, N.J.

[21] Appl. No.: 508,552

[22] Filed: Jun. 28, 1983

[51] Int. Cl.[3] ..... A47F 11/06

[52] U.S. Cl. ..... 272/8 M; 350/123; 350/137

[58] Field of Search ..... 272/8 M, 8 P, 8 D, 8.5, 272/10, 13; 40/219, 411, 489, 490, 491, 541, 577, 582, 611, 160, 900, 1; 434/76, 371; 350/123, 137, 138, 141, 143, 144, 172, 280, 283, 284, 291, 288, 292

[56] References Cited

U.S. PATENT DOCUMENTS

| | | | |
|---|---|---|---|
| 894,599 | 7/1908 | Chaboty | 272/8.5 X |
| 1,019,141 | 3/1912 | Engelsmann | 272/8.5 X |
| 1,456,233 | 5/1923 | Hammond et al. | 350/123 X |
| 1,728,610 | 9/1929 | Horton | 272/8 M |
| 1,821,626 | 9/1931 | Fleischer | 272/8.5 X |
| 2,112,314 | 3/1938 | Spandau | 272/8.5 X |
| 2,903,805 | 9/1959 | Armentrout | 40/160 X |

FOREIGN PATENT DOCUMENTS

| | | | |
|---|---|---|---|
| 747979 | 4/1933 | France | 40/219 |
| 428159 | 5/1935 | United Kingdom | 272/8.5 |
| 711367 | 6/1954 | United Kingdom | 350/137 |
| 2031288 | 4/1980 | United Kingdom | 40/160 |

*Primary Examiner*—Robert A. Hafer
*Assistant Examiner*—Arnold W. Kramer
*Attorney, Agent, or Firm*—Ostrolenk, Faber, Gerb & Soffen

[57] ABSTRACT

A display device comprising a light box, a light source contained therein and a light diffusing translucent cover for said light box is disclosed. A mirror is supported at an acute angle to the upper surface of the light box. A scene or other indicia at the upper surface of the light box is reflected in the mirror and another scene or other indicia are placed on the front of the mirror, whereby a composite view is seen from a position substantially in front of the light box consisting of the projected view reflected in the mirror and the view on or at the mirror surface. Preferably, the scene at the upper surface of the light box reflected in the mirror is a background of a composite view and the scene on or at the surface of the mirror is the foreground of the composite view.

19 Claims, 5 Drawing Figures

FIG. 1
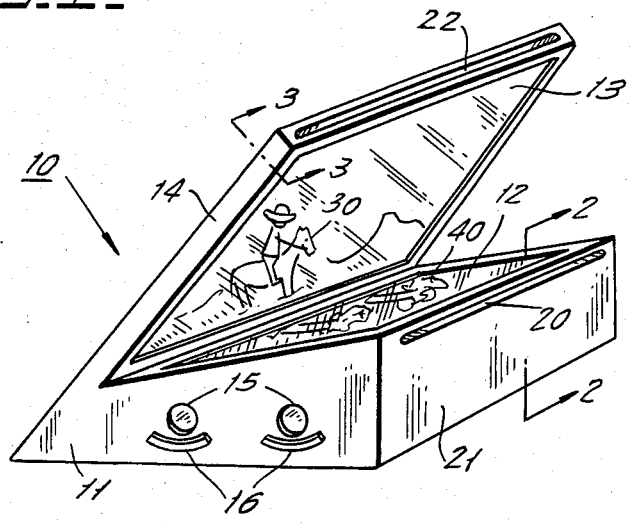
FIG. 2
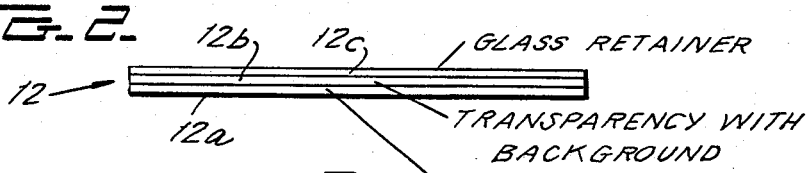
FIG. 3
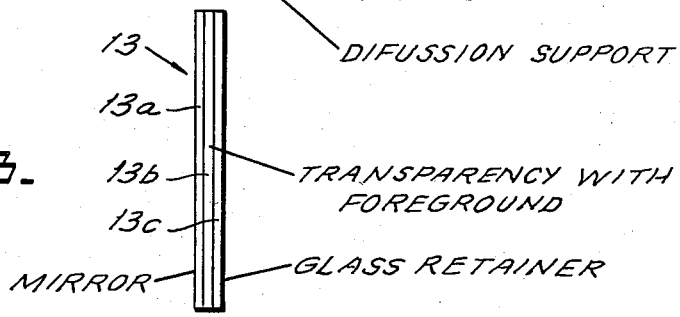
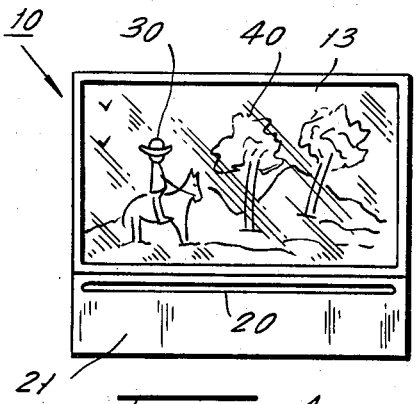
FIG. 4
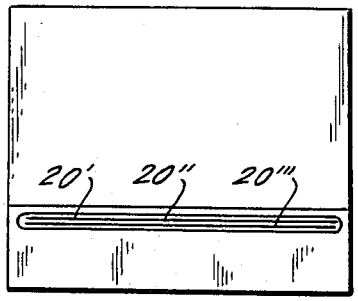
FIG. 5

3D DISPLAY

BACKGROUND OF THE INVENTION

The present invention relates to a three-dimensional display system and more particularly to an advertising or other type of display sign which presents an apparent view in depth on a surface which is essentially two-dimensional and therefore presents the impression of a three-dimensional view of a composite scene. Essentially, the present invention contemplates the utilization of a mirror or other suitable reflective surface on which a foreground scene is placed, either by directly marking, printing or painting the same on the mirror or by laying a transparency carrying the foreground scene on the surface of the mirror. The mirror is at an appropriate angle to a light box having a source of diffused light on which a transparency may be placed through which the diffused light is transmitted. The transparency carries an appropriate background scene. The mirror is at an acute angle to the upper surface of the light box that the light with the background image transmitted thereby will be reflected from the mirror in a direction calculated to be most likely to be intercepted by a viewer.

It has been found that the combination of the light box with a background scene transmitted by diffused light therefrom to the mirror and the mirror carrying at its front surface the foreground scene produces an unexpected and startling effect creating an impression of depth and consequently creating a three-dimensional effect.

Ordinarily, three-dimensional effects are supposed to occur because of human binocular vision. However, with the interocular distance of the order of only three inches, the base line for obtaining an appreciable difference in the images received is such that images approximately 15–20 feet or further from the viewer do not vary sufficiently from each other to produce the three-dimensional effect. Hence, a view in depth or a three-dimensional effect, when obtained by the ordinary viewer of an object more than 15 or 20 feet distant, is based on the background of the viewer himself; that is, the experience he has had in viewing near and distant objects and the relationships among different planes of the objects which are viewed.

By separating the image which is transmitted to the eye into at least two separate planes containing respectively foreground and background images, the eye is induced to accept the composite image which is received as an image which appears to have depth and hence a three-dimensional quality. This is further enhanced by the fact that because the background image is spaced apparently further back from the foreground image by the distance from the light box to the mirror, the two different planes carrying the foreground and background images are not merely on two separate planes but the two planes are substantially separated from each other by an appreciable distance considering the distance from which the display is to be viewed. That is, a relatively small display having a mirror of the order of 15 square inches or of appropriate rectangular proportions would be viewed at a distance of perhaps up to 10 feet, while a larger display twice the size might be viewed at a substantially greater distance. Correspondingly, the spacing between the background image plane and the foreground image plane in the two different structures would be related to the size of the structure and thereby produce the same effect whether the display structure is large or small.

Many attempts have been made to obtain three-dimensional effects in display material. Such attempts have included the presentation of scenes taken from slightly different angles to take advantage of the interocular base. In most cases, such attempts have resulted in the need for interleaving strips of the picture on various backgrounds, including a corrugated or angled background so that different surfaces will be presented to each of the two eyes. This requires an exact positioning of the eyes or results in an abrupt series of changes in the picture viewed as a person passes by. Other attempts have been made by the utilization of mirrors to overlap images and attempt to produce the effect of seeing around the corner. Attempts have also been made with special types of viewers to present separate images or images which vary sufficiently from the normal experience, so that the eye could be confused. This relates to images on structures which polarize the light, requiring corresponding viewing devices and to devices which effectively separate the images presented to each eye and the angle of view available to each eye.

OBJECTS AND BRIEF SUMMARY OF THE INVENTION

The present invention has for its object presentation of a display which provides the appearance of a view in depth and therefore a three-dimensional view, wherein the essential element of the invention is the presentation of background and foreground material appropriately illuminated in separate planes which are spaced from each other.

A further and equally important object of the present invention is the presentation of the foreground and background indicia or views in a structure, wherein the foreground material is carried by a mirror angled with respect to a substantially horizontal light box having a picture supporting surface through which diffused light is projected onto the mirror. The light box surface having the background material and the mirror carrying the foreground material are viewed simultaneously as a scene on the mirror surface, producing thereby the appearance of depth which is justified by the spacing of the foreground and background material at a substantial distance from each other and thereby creates the illusion of three-dimensional viewing.

A still further object of the present invention is the presentation where desired of multiple background material simultaneously by utilizing a plurality of transparencies over the diffused light source impinging on the mirror in combination with either a single view with the foreground material placed on the mirror or multiple transparencies carried by the mirror and somewhat spaced from each other. The background material may also consist of one or more background scenes on separate transparencies in combination with one or more foreground scenes on different transparent structures; the background scene being at the surface of the light box and the foreground scene on or at the surface of the mirror.

A further object of the present invention is by the utilization of diffused light transmitted through the background scene to the mirror, the said diffused light being reflected by the mirror and the background scene being similarly reflected by the mirror and also with the foreground scene on or at the mirror surface itself, with the result that an unusual and unexpected view is presented which carries the strong visual impression of depth and therefore carries with it the strong illusion of a three-dimensional arrangement. Because of the spacing of the foreground and background images in two different planes spaced from each other and the transmission of light through the background image to the mirror and the reflection of light from the foreground image, together with the reflection from the mirror of the background image a presentation is made which is truly in depth. Particularly, the display gives the impression that you can see around the object—that is, you see different background views with respect to foreground as the observer changes his angular position with respect to the display. This presentation carries with it a true and not illusory startling concept of depth because of the actual spatial separation of the two planes.

BRIEF DESCRIPTION OF THE DRAWINGS

The foregoing and many other objects of the present invention will become apparent in the following description and drawings, in which:

FIG. 1 is a view in perspective of one display structure which may be utilized embodying the principles of the present invention;

FIG. 2 is a cross-sectional view taken on line 2—2 of FIG. 1 looking in the direction of the arrows;

FIG. 3 is a cross-sectional view taken on line 3—3 of FIG. 1 looking in the direction of the arrows;

FIG. 4 is a front elevation of the display unit of the present invention, showing diagrammatically the composite scene which is transmitted; and FIG. 5 is a front view of a modified form of the present invention.

DETAILED DESCRIPTION OF THE INVENTION

Referring to FIGS. 1-4, the display 10 is provided with light box 11 having an upper transparent composite surface structure 12, hereinafter more particularly described in connection with FIG. 2. A mirror 13 is mounted at an acute angle preferably approximately 42° to the surface 12 and is supported by a support stand 14 which may be integral with the light box 11. That is, it is possible to make the support 14 for the mirror 13 horizontally adjustable to obtain various angles between the mirror 13 and the surface 12. In the present invention, it is most important that a composite image be reflected to the viewer in a predetermined direction determined by the expected path which the viewer will take and the height of the viewer as he may pass by. Therefore, it is preferable to choose a selected angle for a light box which is to be viewed by passersby of average height and it has been found that the angle of approximately 42° will satisfy most requirements.

For various types of viewing as, for instance, where the viewer's eye may be on a level with the mirror rather than above the mirror, the angle selected between the mirror 13 and the surface 12 may be different. For this purpose, surfaces 13 and 12 may be made adjustable with respect to each other. As previously pointed out, surface 12 will carry a background image but will transmit the background image by diffused light to the mirror 13. The mirror 13 will have on its front surface the foreground image 30 which will be viewed directly by the viewer. The combination of the illuminated background image plus the illumination striking the mirror and the foreground image on the mirror produces a startling and unexpected three-dimensional effect.

The light box 11 carries light source or sources 15 which may preferably be fluorescent tubes with appropriate reflectors 16 and a light diffusing support at the surface 12 for the image carried thereby. As seen in FIG. 2, the surface 12 may be a multi-layer surface consisting of the light diffusing transparent support 12*a*, an additional transparency 12*b* which carries the image which is to form the background and a fully transparent or glass cover plate 12*c*. The cover plate may be omitted and the transparency 12*b* may even be adhesively attached to support 12*a*. The transparency 12*b* may itself be a matte light diffusing member carrying the background image or may be formed directly on support 12*a*, as by printing.

Using the structure illustrated in FIG. 2, it is possible to make the background image interchangeable by providing an appropriate slot 20 in the front wall 21 of the light box 11 to provide access for removal of the transparency 12*b* carrying the image and replacement thereof. Instead of being provided in the front wall 21, a slot may be provided in either of the side walls or in the back wall. Where such a slot is used and the transparency 12*b* is used, it is desirable to have an additional support for transparency 12*b* as well as a transparent cover plate 12*c*.

In a similar manner, the mirror section 13 may comprise the mirror 13*a* having preferably a front reflecting surface, a transparency 13*b* carrying the opaque foreground image and the transparent or glass retainer 13*c* to protect and support the transparency 13*b*. An appropriate slot 22 may be provided in any surface as, for instance, the upper edge of the mirror frame, to permit interchangeability of the foreground image carrying transparency 13*b*. It is also possible to paint or otherwise place the image directly on the mirror and thereby dispense with the intermediate transparency 13*b* and the glass retainer 13*c*. The foreground image carrier 13*b* may even be a matte sheet which may be removably adhered to the mirror surface.

It should now be apparent that the viewer, in passing by, will see the light reflected from the mirror 13, the foreground image 30 and the background image 40 directly superposed with respect to each other, as seen in FIG. 4. The background image is initially in a different plane from the foreground image but appears as part of a single composite view on the reflective surface of the mirror 13. The background image 40 will also appear in part of the foreground image 30 since the background image is reflected from the front surface of the mirror 13 and the front surface of the foreground image 30. However, by choosing appropriate colors and color tones for the background and the foreground, as well as using a relatively non-reflecting matte finish material for the foreground image, the effect of reflection of the background image from the front parts of the foreground image will be minimized.

In FIG. 5 there is shown a modified form of the invention wherein a plurality of slots 20', 20'' and 20''' and a plurality of internal supports (not shown) may be provided for one or more additional transparencies of the type of transparency 12*b* to carry additional images. In other words, the initial slot 20 in FIG. 1 of the structure herein described may be made wide enough to carry not only one transparency with the background material, but two or three or even four such transparencies in which the images will be spaced from each other by the thickness of the transparency, particularly where the images are carried as is expected on the outer surface only of each of the transparencies. Additional supports may be provided in the form of either multiple diffusing plates 12*a* or a single diffusing plate 12*a* together with other transparent plates for the different background images in order to space them further from each other as required. Similarly, the transparency 13*b* which carries the foreground image where the image is not merely painted or marked on the front surface of the mirror may constitute a plurality of such transparencies in which the image is spaced from each other by the thickness of the transparency or additional supports may readily be provided to obtain other spacings.

The primary element of the present invention, however, is the placement of the background image with a light source behind it in the light box and reflecting this background image from the light box by a diffused light off a mirror at an acute angle to the light box to the viewer, together with placing a foreground image at the front surface of the mirror. The utilization of transparencies to carry the image, rather than painting the image directly on the light diffusing support 12*a* and rather than simply placing the image directly on the surface 13*a* of the mirror is to provide for interchangeability of the scenes where that is desired and is not essential to the invention.

By this means, therefore, a display device is created wherein the background image and the foreground image are simultaneously displayed with the background image being projected to a mirror at an angle to the background image and then projected to the viewer from the mirror and wherein the foreground image is at the mirror surface and wherein the composite view presents a startling and unexpected impression of depth and hence of a three-dimensional arrangement.

In the foregoing, the present invention has been described solely in connection with preferred illustrative embodiments thereof. Since many variations and modifications of the present invention will now be obvious to those skilled in the art, the scope of this invention should be determined not by the specific structures herein disclosed, but only by the appended claims.

What is claimed is:

1. A display device, comprising:

a generally planar light transmitting surface having a background image located thereat;

a generally planar mirror having a foreground image located thereat;

first means for projecting light through said light transmitting surface onto said mirror for reflection thereby;

second means for maintaining said light transmitting surface at an acute angle with respect to said mirror such that said light transmitting surface may be viewed by looking at said mirror along an axis which is within said acute angle whereby said background and foreground images are superimposed on each other when viewed along said axis to create the illusion that the background image is located behind said foreground image thereby creating a three-dimensional scene.

2. The display device of claim 1, further including a light box, said light transmitting surface constituting one surface of said light box, and a light source defining said first means and being located in said light box.

3. The display device of claim 2, wherein said second means includes a support for said mirror which is integral with said light box.

4. The display device of claim 2, wherein said background image is formed on a light transmitting image carrier positioned at said light transmitting surface.

5. The display device of claim 4, wherein a transparent cover is provided for said image carrier.

6. The display device of claim 4, wherein said image carrier is replaceable and removable.

7. The display device of claim 6, wherein slots are provided in said light box to permit removal and replacement of said image carrier.

8. The display device of claim 7, further including means for mounting a plurality of transparent image carriers together above said light transmitting surface of said light box.

9. The display device of claim 2, wherein said foreground image is formed on a sheet which is adhered to a front surface of said mirror.

10. The display device of claim 9, wherein said sheet is removable and replaceable.

11. The display device of claim 10, further including means for mounting a plurality of transparent image carriers at said mirror.

12. The display device of claim 1, wherein said light transmitting surface is light diffusing as well as light transmitting.

13. The display device of claim 1, wherein said background image is formed on a light transmitting substrate which is located on said light transmitting surface.

14. The display device of claim 13, wherein said background image is a light transmitting image so that said light projected through said light transmitting surface by said first means also passes through said background image and is projected onto said mirror.

15. The display device of claim 14, wherein said background image is formed with a matte surface.

16. The display device of claim 1, wherein said first means comprises a light source located below said light transmitting surface and projecting light through said light transmitting surface and onto said mirror.

17. The display device of claim 16, wherein said background image is a light transmitting image so that said light projected through said light transmitting surface by said light source also passes through said background image and is projected onto said mirror.

18. The display device of claim 17, wherein said background image is formed with a matte surface.

19. The display device of claim 1, wherein said mirror is a fully reflecting mirror.

* * * * *